US007581656B2

(12) United States Patent
Gnepper et al.

(10) Patent No.: US 7,581,656 B2
(45) Date of Patent: Sep. 1, 2009

(54) ONE-PIECE BOX-SHAPED CONTAINER WITH LARGE LABEL WRAP SURFACE

(75) Inventors: Maurice R. Gnepper, Fremont, OH (US); John M. Shingle, Perrysburg, OH (US)

(73) Assignee: Rexam Prescription Products Inc., Perrysburg, OH (US)

( * ) Notice: Subject to any disclaimer, the term of this patent is extended or adjusted under 35 U.S.C. 154(b) by 197 days.

(21) Appl. No.: 11/487,665

(22) Filed: Jul. 17, 2006

(65) Prior Publication Data

US 2008/0011761 A1 Jan. 17, 2008

(51) Int. Cl.
*B65D 8/04* (2006.01)

(52) U.S. Cl. ..... 220/608; 220/283; 220/263; 220/604; 206/459.5; 206/534; 215/224

(58) Field of Classification Search ..... 220/608, 220/283, 263, 604; 206/459.5, 534; 215/224
See application file for complete search history.

(56) References Cited

U.S. PATENT DOCUMENTS 3,148,103 A * 9/1964 Gallagher ..... 156/224
3,342,379 A * 9/1967 Foley ..... 222/173
4,170,315 A 10/1979 Dubach et al.
4,444,326 A * 4/1984 Musel ..... 215/209
D276,137 S 10/1984 Vere et al.
4,570,818 A * 2/1986 Borst et al. ..... 220/835
4,746,008 A * 5/1988 Heverly et al. ..... 206/1.5
4,787,526 A * 11/1988 Pehr ..... 215/216
4,809,874 A 3/1989 Pehr
4,925,041 A * 5/1990 Pehr ..... 215/216
5,031,784 A 7/1991 Wright
5,082,114 A * 1/1992 Bunin ..... 206/539
5,083,671 A * 1/1992 Hayes ..... 215/245
5,137,260 A * 8/1992 Pehr ..... 215/216
5,270,011 A 12/1993 Altherr
5,346,069 A * 9/1994 Intini ..... 206/531

(Continued)

FOREIGN PATENT DOCUMENTS

EP 1236651 A1 9/2002

*Primary Examiner*—Anthony D Stashick
*Assistant Examiner*—Christopher B McKinley
(74) *Attorney, Agent, or Firm*—Reising Ethington PC

(57) ABSTRACT

A container includes a container base and a lid interconnected by a hinge and being of one-piece integrally molded plastic construction. The container base is of generally rectangular outline having a back wall to which the hinge is connected, a front wall, opposite sidewalls and an open end. The front wall is connected to the back wall opposite the open end by a continuously curving end wall so that the front wall, the back wall and the continuously curving end wall form a continuous surface for application of a label to the front wall, the back wall and the continuously curving end wall. The sidewalls have flat coplanar edges opposite the open end to permit the container to be stood on end with the open end facing upwardly. The container preferably includes a child-resistant latch having a first latch element on the lid opposite the hinge and a second latch element on the front wall of the container ban adjacent to the open end and opposite the hinge. A continuous label may be applied to the front wall, the back wall and the continuously curving end wall of the container.

5 Claims, 2 Drawing Sheets

U.S. PATENT DOCUMENTS 5,353,946 A * 10/1994 Behrend ..... 220/326
5,356,017 A * 10/1994 Rohr et al. ..... 215/216
5,368,798 A 11/1994 Mizukoshi et al.
5,577,779 A * 11/1996 Dangel ..... 292/80
5,605,245 A * 2/1997 Bemis et al. ..... 220/324
D379,923 S * 6/1997 De Baschmakoff ..... D9/697
D389,064 S * 1/1998 Sethi et al. ..... D9/521
D404,531 S * 1/1999 Bakic et al. ..... D28/76
D422,408 S 4/2000 Schwartz et al.
D425,408 S * 5/2000 Bakic ..... D9/695
D430,728 S 9/2000 Horvath et al.
D445,338 S * 7/2001 Helleu ..... D9/521
D474,408 S * 5/2003 Rennie et al. ..... D9/521
6,772,902 B1 * 8/2004 White ..... 220/283
7,104,416 B2 * 9/2006 Gasco et al. ..... 220/608
D543,843 S * 6/2007 Gehring et al. ..... D9/425
7,311,205 B2 * 12/2007 Adler et al. ..... 206/534
D566,330 S * 4/2008 Angeletta ..... D28/7
7,413,082 B2 * 8/2008 Adler et al. ..... 206/534
2005/0023285 A1 2/2005 Keung
2006/0163103 A1 * 7/2006 Adler et al. ..... 206/459.5

* cited by examiner

ONE-PIECE BOX-SHAPED CONTAINER WITH LARGE LABEL WRAP SURFACE

The present disclosure relates to a one-piece box-shaped plastic container, and more particularly to a child-resistant package in which the container has a large continuous label-wrap surface.

BACKGROUND AND SUMMARY OF THE DISCLOSURE

A general object of the present disclosure is to provide an economical box-shaped container for tablets or the like in which the container is of one-piece integrally molded plastic construction and has a large continuous surface for application of a wrap-around label.

The present disclosure embodies a number of aspects that can be implemented separately from or in combination with each other.

A container in accordance with one aspect of the present disclosure includes a base and a lid interconnected by a hinge and being of one-piece integrally molded plastic construction. The container base is of generally rectangular outline having a back wall to which the hinge is connected, a front wall, opposite sidewalls and an open end. The front wall is connected to the back wall opposite the open end by a continuously curving end wall so that the front wall, the back wall and the continuously curving end wall form a continuous surface for application of a label to the front wall, the back wall and the continuously curving end wall. The sidewalls have flat coplanar edges opposite the open end and adjacent to the continuously curving end wall to permit the container to be stood on end with the open end facing upwardly. The container preferably includes a child-resistant latch having a first latch element on the lid opposite the hinge and a second latch element on the front wall of the container base adjacent to the open end and opposite the hinge. A continuous label may be applied to the front wall, the back wall and the continuously curving end wall of the container.

BRIEF DESCRIPTION OF THE DRAWINGS

The disclosure, together with additional objects, features, advantages, and aspects thereof, will best be understood from the following description, the appended claims and the accompanying drawings, in which:

DETAILED DESCRIPTION OF PREFERRED EMBODIMENTS

Figure 1:
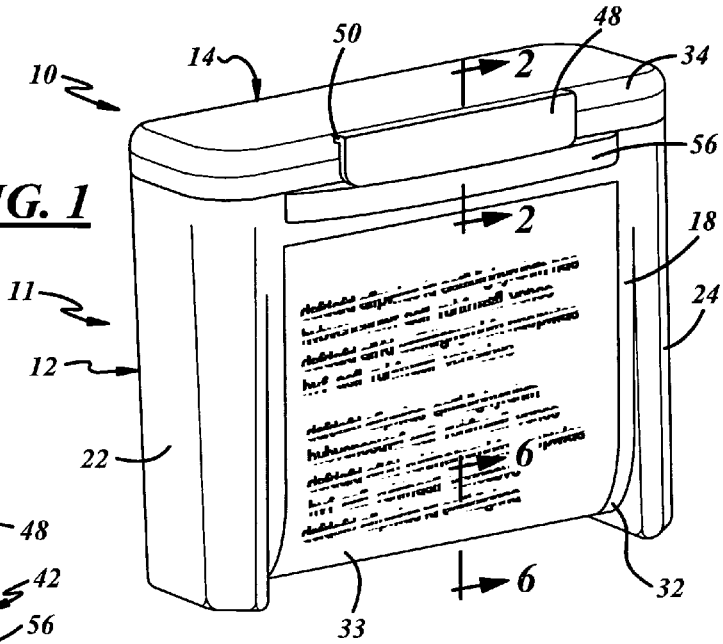
FIG. 1 is a perspective view of a package in accordance with an exemplary embodiment of the present disclosure.

The drawings illustrate a package 10 in accordance with an exemplary embodiment of the present disclosure as including a container 11 having a generally rectangular base 12 and a lid 14 connected to the base by an integral laterally extending hinge 16. Container base 12 is generally rectangular in outline having a front wall 18, a back wall 20, opposed sidewalls

Figure 4:
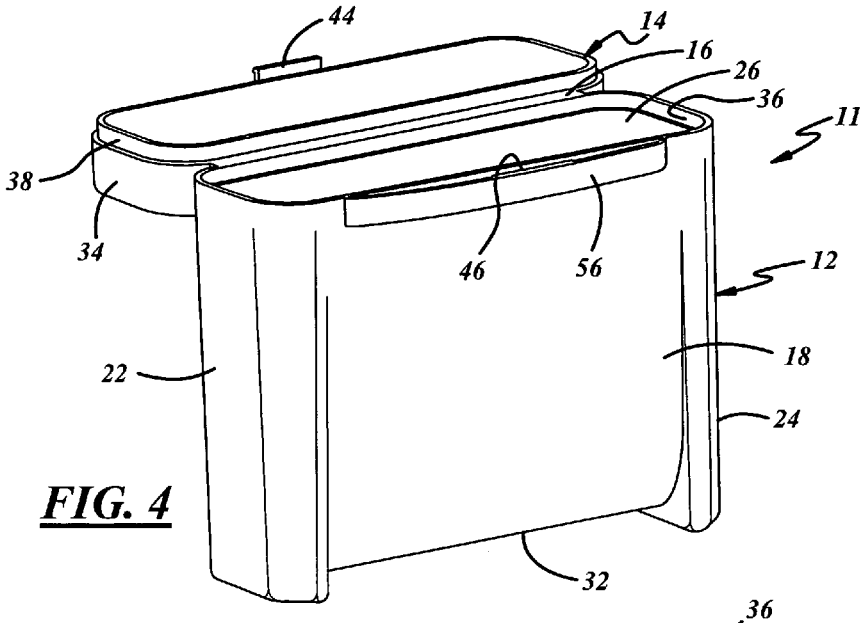
FIG. 4 is a perspective view of the container in the package in FIG. 1 with the lid open.
Figure 5:
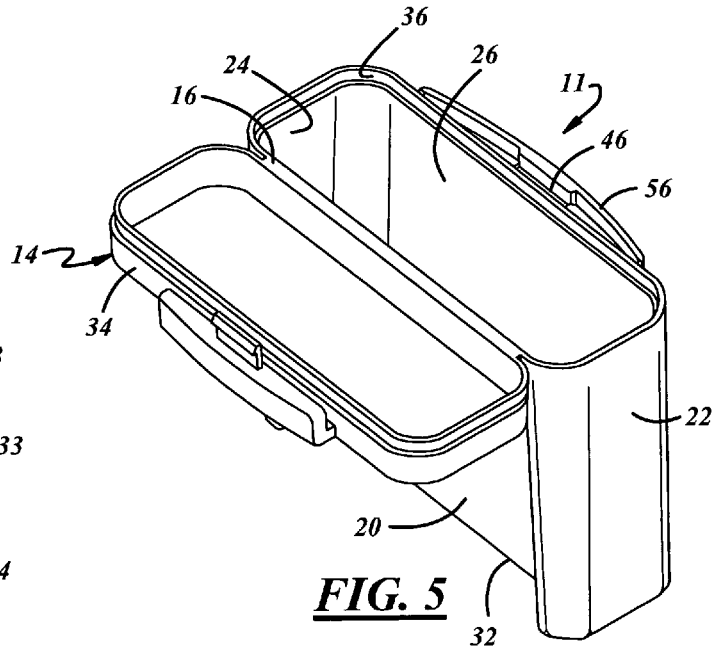
FIG. 5 is a perspective view of the container in FIG. 4.

22,24 and an open end 26. Sidewalls 22,24 have coplanar edges 28,30 opposite open end 26 to permit the container to be stood on end with lid 14 open (FIGS. 4 and 5) or closed (FIG. 1). Front wall 18 is connected to back wall 20 opposite open end 26 by a continuously curving end wall 32 between edges 28,30 of sidewalls 22,24. Continuously curving end wall 32 permits a large wrap-around label 33 (FIGS. 1, 3 and 6) to be applied from front wall 18 around end wall 32 onto back wall 20.

Figure 2:
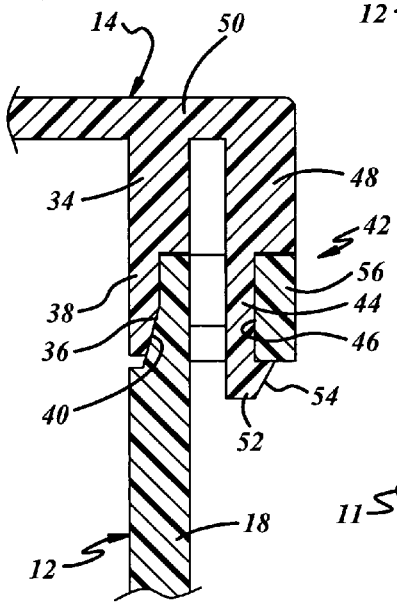
FIG. 2 is a fragmentary sectional view taken substantially along the line 2-2 in FIG. 1.
Figure 3:
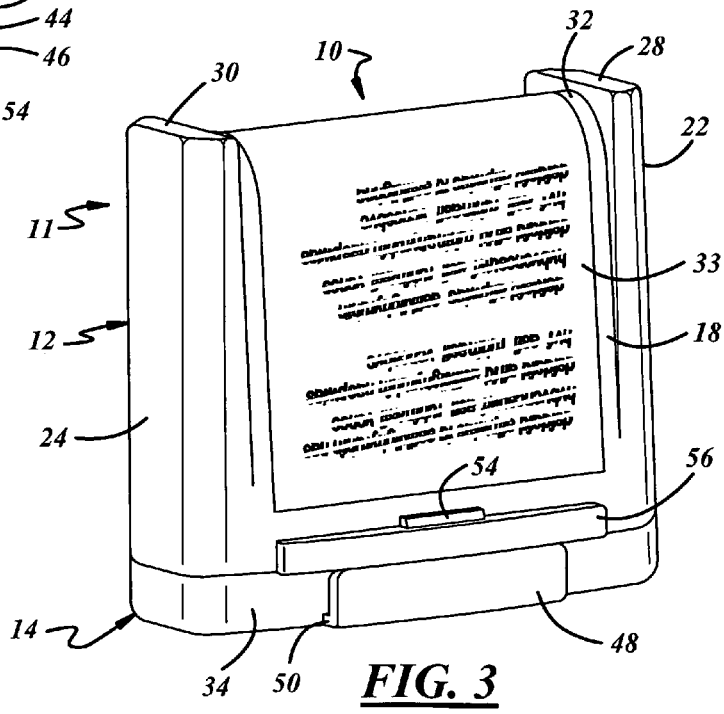
FIG. 3 is a perspective view of the package in FIG. 1 stood on the lid.

Lid 14 is generally flat to permit package 10 to be stood on the lid when the lid is closed, as illustrated in FIG. 3. Lid 14 is generally rectangular, following the rectangular outline of container 12, and has a generally linear edge connected to a generally linear edge of back wall 20 by laterally extending hinge 16. Hinge 16 preferably is continuous, but could be segmented. Lid 14 has a continuous peripheral wall 34 that abuts the edges of front wall 18, back wall 20 and sidewalls 22, 24 that form the continuous generally rectangular planer edge of the container base 12 around open end 26. A continuous flange 38 extends from wall 34 and is received within open end 26 of container 12 when the lid is closed, as illustrated in FIG. 2. There preferably is a continuous internal angulated sealing surface 36 that extends around the open end of container base 12. Sealing flange 38 preferably has an angulated surface 40 for sealing engagement with surface 36 in the closed position of lid 14 over the open end of container base 12.

Figure 6:
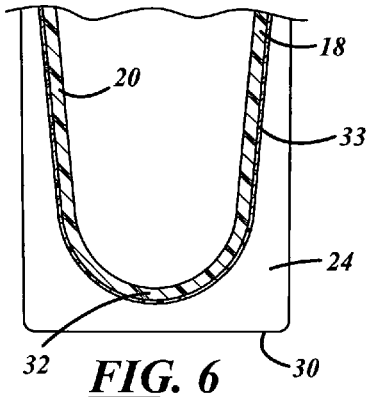
FIG. 6 is a fragmentary sectional view taken substantially along the line 6-6 in FIG. 1.

As best seen in FIGS. 3 and 6, end wall 32 preferably is disposed adjacent to but beneath the plane of sidewall edges 28, 30 so as not to interfere with standing the container on end. Sidewalls 18, 20 preferably are substantially flat and preferably angle toward each other between open end 26 and end wall 32. Sidewalls 18, 20 may be slightly curved if desired. There preferably are no abrupt changes in the geometry of the wrap-around surface provided by front wall 18, back wall 20 and end wall 32 that would interfere with application of wrap-around label 33. Label 33 typically would be applied to container 11 to from package 10 by a product packager before or after filing container 11 with product. However, label 33 could be applied by the container manufacturer.

A child-resistant latch 42 preferably is provided between lid 14 and container base 12 opposite hinge 16. Latch 42 preferably includes a latch arm 44 that extends from lid 14 opposite hinge 16 and a slot 46 on container 12 at open end 26 opposite hinge 16. Latch arm 44 preferably extends from a tab 48 having a leg 50 that cantilevers tab 48 from the front edge of lid 14 (i.e, the edge of lid 14 opposite hinge 16 at the back edge of the lid). Latch arm 44 has an end lug 52 with an external cam surface 54. Slot 46 preferably is provided as a gap between front wall 18 of container 12 and a strap 56 that extends along front wall 18 at the open end of the container. As lid 14 is closed, cam surface 54 of latch arm 44 engages the upper inside edge of strap 56 and cams latch arm 44 into slot 46. Lug 52 catches beneath strap 56 to lock the lid closed. To open the lid, tab 48 is pushed inwardly against the resilient force supplied by leg 50 until lug 52 clears strap 56, at which point tab 48 can be pushed upwardly to open the lid. Package 10, including lid 14, container 12 and hinge 16, preferably is of one-piece integrally molded plastic construction.

There thus has been disclosed a container that fully satisfies all of the objects and aims previously set forth. The disclosure has been presented in conjunction with an exemplary embodiment, and a number of modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A box-shaped container that includes:

a base and a lid interconnected by a hinge and being of one-piece integrally molded plastic construction, said base being of generally rectangular outline having a back wall to which said hinge is connected, a front wall, opposite sidewalls, an open end and a generally rectangular continuous internal sealing surface extending around said open end, said front wall being connected to said back wall opposite said open end by a continuously curving end wall disposed between said sidewalls so that said front wall, said back wall and said continuously curving end wall form a continuous surface for application of a label, said sidewalls having flat coplanar edges opposite said open end and adjacent to said continuously curving end wall to permit said box-shaped container to be stood on end with said open end facing upwardly, said lid being flat to permit said box-shaped container to be stood on said lid and of generally rectangular outline following said generally rectangular outline of said base, having a peripheral wall and a generally rectangular continuous sealing flange extending from said peripheral wall for plug-sealing receipt in said open end of said base in engagement with said sealing surface of said base.

2. The container set forth in claim 1 including a child-resistant latch having a first latch element on said lid opposite said hinge and a second latch element on said front wall adjacent to said open end and opposite said hinge, wherein said second latch element includes a slot formed between said front wall and a strap molded onto said front wall, and wherein said first latch element includes a latch arm that extends from a tab cantilevered from a front edge of said lid opposite said hinge and includes an end lug that catches beneath said strap to lock said lid closed and said tab is depressible between said strap and said front edge to open said lid.

3. A package that includes the container set forth in claim 2 and a label that extends along external surfaces of said front wall said end wall and said back wall.

4. A box-shaped container that includes:

a container base and a lid interconnected by a hinge and being of one-piece integrally molded plastic construction, said container base being of generally rectangular outline having a back wall to which said hinge is connected, a front wall, opposite sidewalls, an open end and a generally rectangular continuous internal sealing surface extending around said open end, said sidewalls having flat coplanar edges opposite said open end to permit said box-shaped container to be stood on an end with said open end facing upwardly, said lid being of generally rectangular outline following said generally rectangular outline of said base, having a peripheral wall and a generally rectangular continuous sealing flange extending from said peripheral wall for plug-sealing receipt in said open end of said base when said lid is closed, and flat to permit said box-shaped container to be stood on said lid with said lid closed, said front wall being connected to said back wall adjacent to said edges of said sidewalls opposite said open end by a continuously curving end wall disposed between said sidewalls so that said front wall, said back wall and said continuously curving end wall form a continuous surface for application of a label, and a child-resistant latch having a first latch element comprising a latch arm extending from a tab cantilevered from a front edge of said lid opposite said hinge and a second latch element comprising a slot at said front wall adjacent to said open end opposite said hinge and formed between said front wall and a strap molded onto said front wall, said latch arm being receivable in said slot to close said box-shaped container, wherein said latch arm includes an end lug that catches beneath said strap to lock said lid closed and said tab is depressible between said strap and said front edge to open said lid.

5. A package that includes the container set forth in claim 4 and a label that extends along external surfaces of said front wall, side end wall and said back wall.

* * * * *